United States Patent [19]

Feuling

[11] 4,263,982

[45] Apr. 28, 1981

[54] MUFFLER FOR INTERNAL COMBUSTION ENGINES AND METHOD OF MANUFACTURING SAME

[76] Inventor: James J. Feuling, 686 Ash Ave., Chula Vista, Calif. 92010

[21] Appl. No.: 63,670

[22] Filed: Aug. 6, 1979

[51] Int. Cl.[3] ..... F01N 1/24

[52] U.S. Cl. ..... 181/256; 181/264

[58] Field of Search ..... 181/222, 247, 252, 256–259, 181/264, 251, 268, 275, 282

[56] References Cited

U.S. PATENT DOCUMENTS

| | | | |
|---|---|---|---|
| 2,373,231 | 4/1945 | Demuth | 181/264 |
| 2,613,758 | 10/1952 | Cullum | 181/256 |
| 2,958,388 | 11/1960 | Paulsen | 181/256 |
| 2,990,906 | 7/1961 | Audette | 181/256 |
| 3,114,431 | 12/1963 | Sanders | 181/256 |

FOREIGN PATENT DOCUMENTS

| | | | |
|---|---|---|---|
| 1283147 | 12/1961 | France | 181/256 |

*Primary Examiner*—L. T. Hix

*Assistant Examiner*—Thomas H. Tarcza

*Attorney, Agent, or Firm*—Frank D. Gilliam

[57] ABSTRACT

A muffler for use with internal combustion engines or the like having improved sound attenuation capabilities together with lower back pressure. The muffler has an elongated outer casing connected to inlet and outlet pipes by inlet and outlet transition sections. A central diffuser body is located within the outer casing substantially along the longitudinal centerline thereof. Mounting plates connect the front and rear ends of the diffuser body to the inlet and outlet pipes, respectively, to hold the diffuser body in place. An inner casing is spaced from, and conforms to, the inner surface of said outer casing between transition sections. The inner casing and the side wall of the diffuser body are perforated. Porous or fibrous sound absorbing material is contained within the diffuser body and between the inner and outer casings. The cross-sectional areas of the inlet pipe and the ring between the inner casing and the diffuser body are preferably substantially equal.

9 Claims, 6 Drawing Figures

MUFFLER FOR INTERNAL COMBUSTION ENGINES AND METHOD OF MANUFACTURING SAME

BACKGROUND OF THE INVENTION

This invention relates in general to sound attentuation and, more specifically, to mufflers for use with internal combustion engines or the like.

In many devices such as internal combustion engines, turbine engines, compressed gas powered tools, etc., considerable noise energy travels with exhaust gases. Such noise is objectionable and must often be reduced. A wide variety of mufflers and other noise reducing devices have been developed.

Some mufflers use a plurality of baffles to radically change the path of the exhaust gases over a short distance. While such mufflers may be effective in reducing noise levels, they tend to create undesirably high back pressure on the engine, resulting in lower engine power output and lower efficiency.

Other mufflers direct the exhaust gases straight through a perforated tube within a larger tube, with sound absorbing material such as glass fibers, between the two tubes. These so-called "glass-pack" mufflers produce low back pressure, but are not effective in reducing noise levels.

Attempts have been made to combine baffles and sound absorbing materials to improve muffler efficiency. For example, Cullum in U.S. Pat. No. 2,613,758 uses a combination of concentric tubes with sound absorbing material between a perforated inner tube and an outer tube, a narrow tapered-ended perforated cylinder along the muffler centerline and a set of baffles near the muffler exhaust end. Sanders in U.S. Pat. No. 3,114,431 and Paulsen in U.S. Pat. No. 2,958,388 also disclose mufflers having sound absorbing walls and a core of sound absorbing material within the muffler. While these designs somewhat combine the noise reduction characteristics of the baffle-type muffler and the low back pressure of the straight through type muffler, none provide an optimum combination of high engine efficiency through low back pressure and maximum reduction in noise.

Also, some of these prior mufflers are complex and heavy in construction and others have short useful lives due to corrosion or susceptibility to damage from the hot gases passing through them.

Thus, there is a continuing need for improved mufflers for use with internal combustion engines.

SUMMARY OF THE INVENTION

The above problems, and others, are overcome in accordance with this invention by a muffler having an elongated outer casing connected to inlet and outlet pipes by transition sections and a central diffuser body located within the casing. Mounting plates support the diffuser body along the casing centerline. A perforated inner casing is spaced from the inner wall of the outer casing. The sides of the diffuser body are similarly perforated. A sound absorbing material is contained within said diffuser body and between the inner and outer casings.

BRIEF DESCRIPTION OF THE DRAWING

Details of the invention, and of preferred embodiments thereof will be further understood upon reference to the drawing, wherein.

DETAILED DESCRIPTION OF PREFERRED EMBODIMENTS

Figure 1:
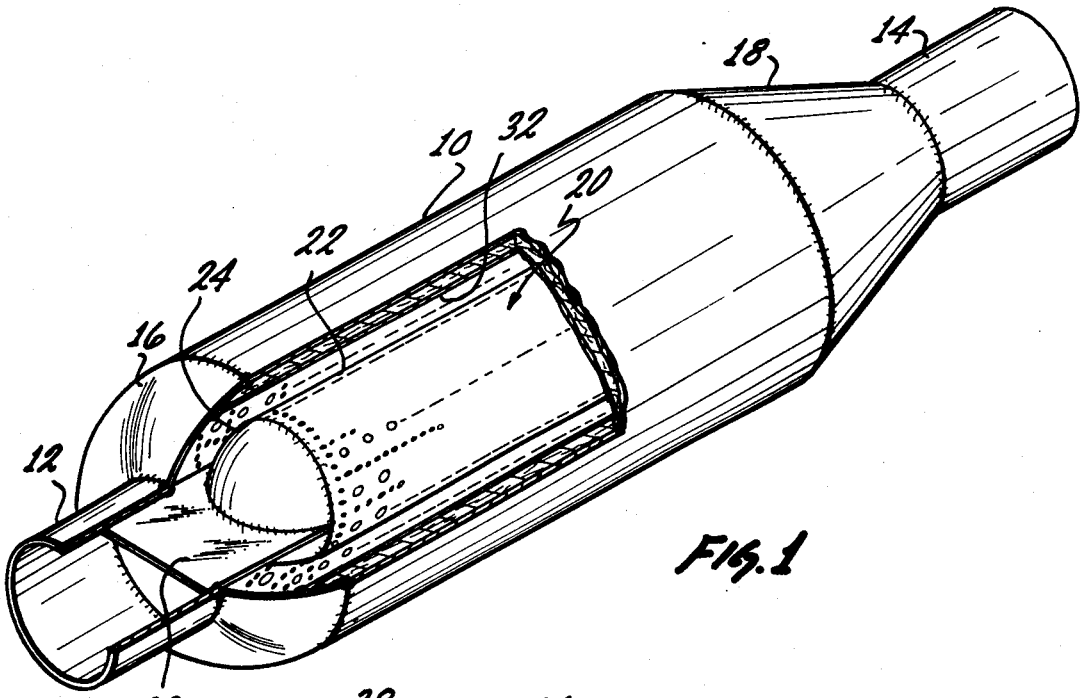
FIG. 1 is a perspective view, partially cut-away, of a first embodiment of the muffler of this invention.
Figure 2:
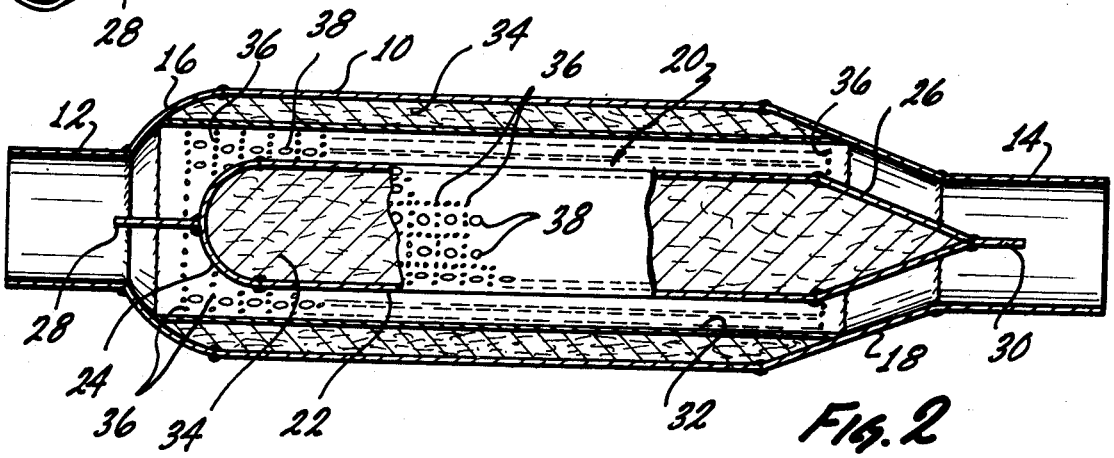
FIG. 2 is a sectional view taken along the longitudinal centerline of the muffler of FIG. 1.
Figure 3:
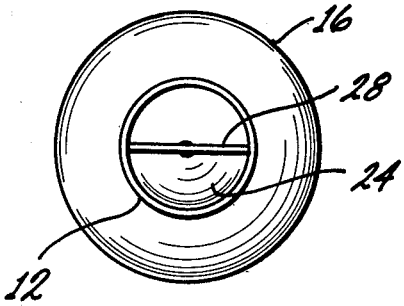
FIG. 3 is an axial elevation view of the muffler of FIG. 1, taken from the left end as seen in FIG. 1.

Referring now to FIGS. 1–3, there is seen a muffler having an outer casing 10 connected to inlet and outlet pipes 12 and 14, respectively, by inlet and outlet transition sections 16 and 18, respectively. A central diffuser body 20 having a perforated side wall 22, a nose section 24 and a tail section 26 is positioned along the longitudinal centerline of the outer casing 10. Diffuser body 20 is held in place by a front plate 28 secured to the front of nose 24 and the interior of inlet pipe 12 and a rear plate 30 secured to tail section 26 and the interior of outlet pipe 14.

A perforated inner casing 32 is located parallel to and inside outer casing 10 and held in place by engagement of the ends of inner casing 32 against the inner walls of transition sections 16 and 18. While inner casing 32 could be held in place by tack welding, if desired, ordinarily the resilience of the inner casing will hold it in place.

A quantity of sound absorbing material 34 is contained within diffuser body 22 and between inner casing 32 and outer casing 10. Any suitable sound absorbing material may be used. Typical fibrous materials may be formed from metal, glass, Kevlar polyarimides, and mixtures thereof. Other sound absorbing materials include glass or ceramic opencell foams, ceramic wool or felt, multiple layers of fine screening, etc. Polyarimide fibers such as those available under the "kevlar" trademark are preferred for best sound absorption together with long useful life.

In the embodiment shown in FIGS. 1–3, the perforations in inner casing 32 and diffuser body wall 22 are in the form of a grid-like arrangement of small holes 36 with larger holes 38 within each grid space. Wile any suitable hole arrangement and hole size may be used, in this embodiment small holes 36 preferrably have diameters in the 0.050 to 0.100 inch range, while large holes 36 preferrably have diameters in the 0.125 to 0.375 inch range. This arrangement of perforations has been found to produce optimum sound absorbing characteristics. While round holes are preferred for an optimum combination of sound absorption and structure strength, holes of other shapes may be used, if desired. The areas of such holes should be equivalent to the areas of round holes having the above-mentioned preferred diameters.

While diffuser body 20 may have any suitable diameter, in the embodiment shown in FIGS. 1–3, it is preferred that the outside diameter of diffuser body 20 be substantially equal to the internal diameter of inlet and outlet pipes 12 and 14. This arrangement results in no direct "line-of-sight" path fron inlet pipe 12 to outlet pipe 14 with minimal disruption of gas flow through the muffler to produce low back pressure with excellent sound absorption.

Figure 4:
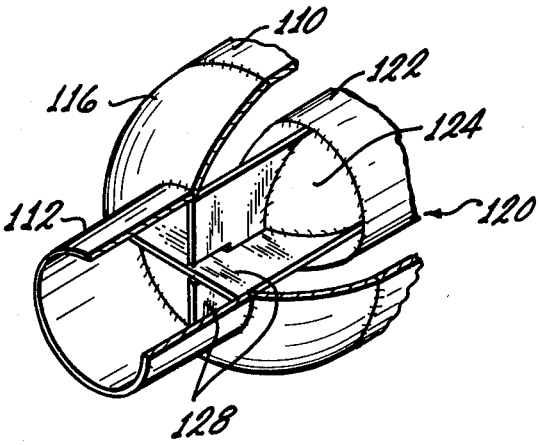
FIG. 4 is a partial perspective view, partially cut-away, of the inlet end portion of a second embodiment of the muffler, illustrating an alternative diffuser body mounting means.

An alternate embodiment of the means to mount the diffuser body within the muffler is illustrated in FIG. 4. Here, the muffler includes an outer casing 110, an inlet transition section 116 and an inlet pipe 112 basically the same as the corresponding components shown in FIGS. 1–3. The diffuser body similarly includes a side wall 122 and a nose section 124. However, in this case instead of one front mounting plate 128, two plates are used, typically at right angles to each other. This arrangement is somewhat more sturdy and rigid than that shown in FIGS. 1–3, but does present slightly more resistance to gases passing through the mounting plate region. The arrangement of FIG. 4 is preferred for especially heavy duty conditions. If desired, a similar pair of mounting plates may be used at the other end (not shown) of diffuser body 120.

Figure 5:
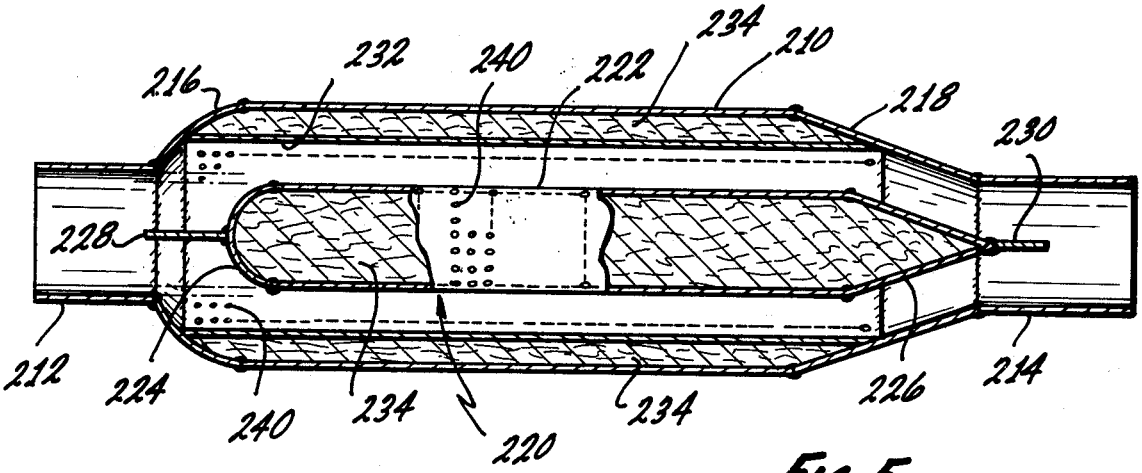
FIG. 5 is a section view taken along the longitudinal centerline of another alternative embodiment of the muffler.

FIG. 5 shows another alternative embodiment in which certain dimensions are varied within the scope of this invention. Here, the muffler includes an outer casing 210, inlet and outlet pipes 212 and 214, respectively, and inlet and outlet transition sections 216 and 218, respectively, all basically identical with corresponding components shown in FIGS. 1–3. A diffuser body 220, located along the muffler centerline, includes a perforated side wall 222, a nose section 224 and a tail section 226 and is supported by mounting plates 228 and 230. An inner casing 232 is provided and a sound absorbing material 234 is contained within diffuser body 220 and between inner and outer casings 232 and 210. In this embodiment the diameter of diffuser body 220 is slightly less than the internal diameter of inlet and outlet pipes 212 and 214. Generally, best results are obtained where diffuser body 220 has a diameter of about 80 to 100 percent of the inlet pipe 212 and outlet pipe 214 diameter. While this arrangement may permit slightly greater sound transmission through the muffler, back pressure is slightly reduced. Also shown in this embodiment is an alternative perforation arrangement, with perforations 240 of uniform size in inner casing 232 and diffuser body wall 222. In general, uniform holes will give best results when the holes have diameters in the 0.050 to 0.375 inch range.

Figure 6:
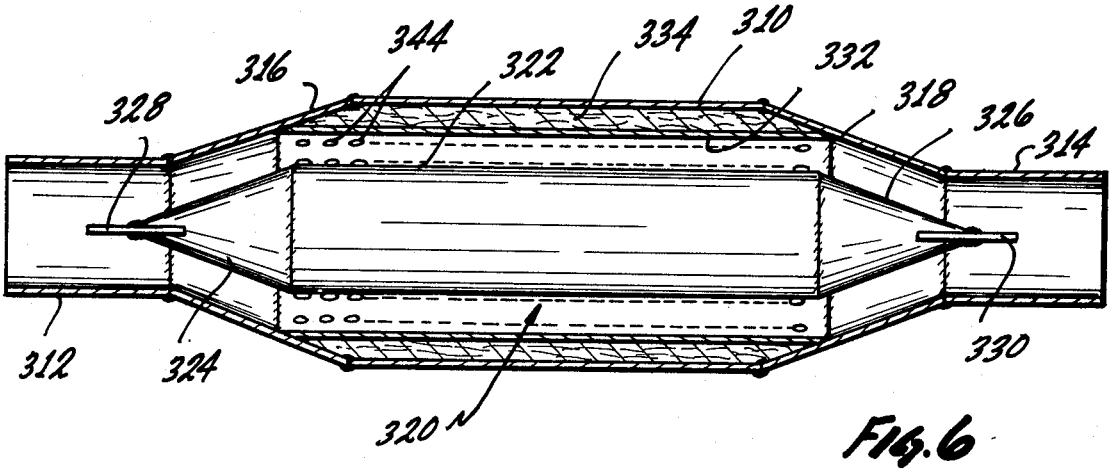
FIG. 6 is a partially sectional view taken along the longitudinal centerline with the outer components in section, of a further embodiment of a muffler according to this invention.

Still another embodiment of the muffler of this invention is shown in FIG. 6. The muffler is basically similar to those described above, with an outer casing 310 connected to inlet and outlet transition sections 316 and 318, respectively. A diffuser body 320 is located on the muffler centerline and consists in this embodiment of a non-perforated side wall 322, a nose section 324 and a tail section 326. The body 320 is mounted by plates 328 and 330 fastened to inlet and outlet pipes 312 and 314, respectively. A perforated inner casing 332 is located just inside outer casing 310. A quantity of sound absorbing material is placed between inner and outer casings 332 and 310. In this embodiment, nose section 324 is conical rather than rounded as in the previous embodiments. While the rounded nose sections are generally preferred, the conical section often gives good results. Also, in this embodiment perforations 344 in inner casing 332 are relatively large, in the 0.125 to 0.375 inch range.

Thus, it can be seen that several of the characteristics of the muffler may be varied within limits to "tune" the muffler for a specific situation. In general, the perforations in the inner casing and diffuser body wall may be large, small or mixed within a 0.050 to 0.375 inch range. One or more mounting plates may be used at each end of the diffuser body, depending on the strength and fluid flow characteristics desired. In general, a single mounting plate at each end is preferred since it usually provides sufficient strength and lower flow restriction.

Best results are obtained where the cross-sectional areas of the inlet and outlet pipes are substantially equal and from about 80 to 120 percent of the area of the cross-sectional ring between diffuser body and the inner casing. For optimum results, these areas should be substantially equal.

Any suitable shape can be used for the nose section and inlet transition section of the casing. While a curvilinear shape, e.g. hemispherical, parabolidal or an ogive, is preferred, a conical shape may be used, if desired. Optimum fluid flow characteristics have been obtained with a hemispherical nose. The diffuser body nose section and the inlet transition section should be substantially parallel. With the rounded shapes, the front end of the diffuser body nose piece should be spaced from the plane where the inlet pipe and the inlet transition section meet a distance equal to about 0.5 to 1.5 times the internal diamter of the inlet pipe for best performance. Optimum results are obtained when that distance is equal to that diameter. The tail section is preferably conical in configuration. The tail section surface ideally is parallel to the outlet transition section surface.

While best results are obtained where the diameter of the diffuser body is substantially equal to the internal diamter of the inlet and outlet pipes, diffuser body diameters as small as 50 percent of the inlet/outlet pipe diamter may be used, if desired.

While the muffler of this invention may be made by any suitable method, certain novel manufacturing processes and steps have been found to be exceptionally convenient and effective and to produce a strong, wear resistance muffler.

In a preferred method (referring to the embodiment of FIGS. 1–3 for convenience, although the embodiments of the other figures can be similarly manufactured), the outer shell or muffler housing, consisting of outer casing 10, inlet and outlet transition sections 16 and 18 and inlet and outlet pipes 12 and 14, is first manufactured. This housing is preferably formed in one piece by conventional metal spinning techniques. Alternatively (especially where the muffler cross-section is other than round) the housing can be fabricated by welding individual components together, which may be formed by stamping, spinning, etc. The complete housing is then cut into two equal halves along a plane which includes the muffler longitudinal axis. Batts of sound absorbing material 34 are placed in the two halves and a perforated inner casing 32 is placed in one half. A diffuser body 20 having mounting plates 28 and 30 and at ends thereof is inserted into the half holding the inner casing 32 and end plates 28 and 30 are welded to inlet and outlet pipes 12 and 14. Then the two housing halves are brought together and welded along the contacting edges, producing a strong, smooth and economical muffler.

The diffuser body 20 with end plates 12 and 14 is preferably welded up from descrete components, each of which is fabricated by spinning, stamping, etc.

In a preferred alternative, the two halves of the muffler housing are welded together before diffuser body 20 is added. In this case, diffuser body 20 is slipped in through one of inlet and outlet pipes 12 and 14, then is welded in place. While the welding of mounting plates to pipes is slightly more difficult in this embodiment, advantages in production line automatic assembly are possible with this method.

In another alternative, which is particularly useful where the muffler has an other-than-round cross-section, piece by piece welding of component parts that may be used to assemble the muffler housing. Transition sections 16 and 18 are welded to the ends of outer casing 10 and pipes 12 and 14 are welded to the transition sections with the longitudinal axes of all components carefully maintained along a single line. The sound absorbing material 34 and inner casing 32 are inserted into outer casing 10 before the second transition section is welded in place. Diffuser body 20, with mounting plates 28 and 30 attached, is slid into the muffler housing through one of pipes 12 and 14, then the mounting plates 28 and 30 are welded to the pipes 12 and 14, producing a solid unitary muffler.

While certain specific proportions, materials and arrangements have been detailed in the above description of preferred embodiments, these may be varied, where suitable, with similar results. For example, the muffler components may be formed from any suitable material, such as steel, aluminum, glass fiber reinforced plastic, etc. Also, while a cylindrical muffler is illustrated, the muffler may have any other desired cross-section, e.g., oval or elliptical.

Other variations, ramifications and applications of this invention will occur to those skilled in the art upon reading the present disclosure. These are intended to be included within the scope of this invention as defined in the appended claims.

I claim:

1. A muffler for use with internal combustion engines comprising:

an elongated tubular outer casing;

an inlet pipe having a cross-sectional area less than that of said outer casing;

an inlet transition section connecting said inlet pipe and a first end of said outer casing in a fluid-tight manner;

an outlet pipe having a cross-sectional area substantially equal to the cross-sectional area of said inlet pipe;

an outlet transition section connecting said outlet pipe and the second end of said outer casing in a fluid-tight manner;

a central diffuser body located concentrically within said outer casing;

said diffuser body including a side wall substantially parallel to said outer casing and nose and tail sections closing the inlet and outlet ends, respectively, of said body;

said diffuser body side wall being perforated and said nose and tail sections being imperforate;

mounting plates having widths substantially equal to the inner diameter of said inlet and outlet pipes fastened between said inlet pipe and said nose section and between said outlet pipe and said tail section to support said body in position;

an inner casing within said outer casing and substantially parallel thereto;

said inner casing being perforated;

a quantity of sound-absorbing material located within said diffuser body and between said outer and inner casings; and the cross-sectional areas of said inlet pipe, said outlet pipe and the ring-like cross-sectional area between said diffuser body side wall and said inner casing being substantially equal.

2. The muffler according to claim 1 wherein said diffuser body nose section is substantially curvilinear and said inlet transition section is substantially parallel to said nose section.

3. The muffler according to claim 2 wherein the inlet end of said nose section is spaced from the plane where said inlet pipe and said inlet transition section meet a distance equal to from about 0.5 to 1.5 times the diameter of said inlet pipe.

4. The muffler according to claim 1 wherein the diameters of said perforations in said diffuser body wall and said inner casing range from about 0.050 to 0.100 inch.

5. The muffler according to claim 1 wherein said mounting plates include at least two plates lying in planes including the longitudinal axis of said muffler connected to each of said nose and tail sections.

6. The method of manufacturing a muffler which comprises the steps of:

providing a muffler housing in two halves separated along a plane lying along the muffler longitudinal axis, said muffler housing consisting of an elongated tubular casing, inlet and outlet pipes and inlet and outlet transition sections connecting said inlet and outlet pipes to said casing;

placing a cylindrical perforated inner casing on one muffler half with the ends of said casing in supported contact with said inlet and outlet transition sections;

inserting an elongated diffuser body having end mounting plates through said inner casing bringing said mounting plates into engagement with said inlet and outlet pipes;

said mounting plates having widths substantially equal to the inner diameter of said inlet and outlet pipes;

welding said mounting plates to said inlet and outlet pipes; and bringing said muffler halves together and welding the contacting edges of said halves.

7. The method according to claim 6 wherein said two muffler halves are welded together prior to welding said mounting plates to said inlet and outlet pipes, and including the step of sliding said diffuser body into said muffler through one of said inlet and outlet pipes until said mounting plates engage said inlet and outlet pipes, then welding said mounting plates to said inlet and outlet pipes.

8. The method according to claim 6 wherein said muffler housing is formed by metal spinning, then cutting said housing along a plane including the muffler longitudinal axis to produce said muffler housing halves.

9. The method of manufacturing a muffler which comprises the steps of:

providing an elongated tubular outer casing;

placing sound absorbing material against the inner wall of said outer casing;

inserting a perforated inner casing into said outer casing in contact with said sound absorbing material;

welding inlet and outlet transition sections to the ends of said outer casing coaxial with said outer casing;

welding inlet and outlet pipes to the ends of said inlet and outlet transition sections coaxial with said outer casing;

inserting a diffuser body having mounting plates at each end into said outer casing through one of said inlet and outlet pipes until said mounting plates engage said pipes; and welding said mounting plates to said inlet and outlet pipes.

* * * * *